US007187395B2

(12) United States Patent
Kato

(10) Patent No.: US 7,187,395 B2
(45) Date of Patent: Mar. 6, 2007

(54) ROLL PAPER FEEDING DEVICE AND PHOTO PRINTER

(75) Inventor: Hisahiro Kato, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 231 days.

(21) Appl. No.: 10/881,365

(22) Filed: Jun. 30, 2004

(65) Prior Publication Data

US 2004/0263605 A1 Dec. 30, 2004

(30) Foreign Application Priority Data

Jun. 30, 2003 (JP) ..... 2003-187618

(51) Int. Cl.
*B41J 11/00* (2006.01)

(52) U.S. Cl. ..... 347/218

(58) Field of Classification Search ..... 347/218, 347/171, 176; 400/621, 624, 625, 611
See application file for complete search history.

(56) References Cited

U.S. PATENT DOCUMENTS 6,827,515 B2 * 12/2004 Harris et al. ..... 400/621

FOREIGN PATENT DOCUMENTS

JP 58-139950 8/1983
JP 11-43245 2/1999

OTHER PUBLICATIONS

Patent Abstracts of Japan, Publication No. 11-043245, Date of Publication: Feb. 16, 1999, 1 page.
Patent Abstracts of Japan, Publication No. 58-139950, Date of Publication: Aug. 19, 1983, 1 page.

* cited by examiner

*Primary Examiner*—K. Feggins
(74) *Attorney, Agent, or Firm*—Osha Liang LLP

(57) ABSTRACT

A roll paper feeding device includes a paper feed roller, a flange holder, a flange pressing portion, a roll paper pressing lever, a housing containing these components therein, and a cover arranged above the housing. The flange holder has a recess having wide opening at an upper surface, and a shaft of the flange axially supporting the roll paper is placed in the recess. The flange pressing portion is provided on the cover, and when the cover is open, the flange pressing portion is moved toward the center of rotation of the cover, by means of a rotating member, a base member and a spring. Consequently, the flange supporting the roll paper on its shaft can easily be set in the flange holder.

4 Claims, 3 Drawing Sheets

ROLL PAPER FEEDING DEVICE AND PHOTO PRINTER

BACKGROUND OF THE INVENTION

1. Field of the Invention

The present invention relates to a photo printer in which an image is thermally formed on a sheet of roll paper and the image is fixed by irradiation with light of a prescribed wavelength. More specifically, the present invention relates to a roll paper feeding device of the photo printer.

2. Description of the Background Art

FIG. 3 is a schematic diagram of the photo printer.

The photo printer employing roll paper includes a roll paper feeding device 1 holding and feeding the roll paper, an image forming device 11 forming an image by heating a sheet of roll paper 100 fed from roll paper feeding device 1 at a prescribed temperature, an image fixing device 12 irradiating the sheet of roll paper on which the image has been formed with ultraviolet ray to fix the image, and a cutting device 13 cutting the sheet of roll paper on which the image has been fixed to a prescribes size to finish a photograph. In such a photo printer, roll paper is consumed as photographs are printed, and the diameter of the roll becomes smaller. Therefore, the roll paper feeding device of a conventional photo printer has such a structure as shown in FIG. 4.

FIG. 4 is a schematic diagram representing the structure of the conventional roll paper feeding device.

As shown in FIG. 4, the conventional roll paper feeding device 1 includes a paper feed roller 4, a flange holder 5, a flange pressing lever 6, a roll paper pressing lever 7, a housing 2 containing these components therein, and a cover 3 arranged at an upper portion of housing 2. Cover 3 is opened and closed by rotation.

Flange holder 5 has an L-shaped slit 51, and holds a flange 101 axially supporting roll paper 100, with a shaft 102 of flange 101 supporting roll paper 100 inserted through L-shaped slit 51. Shaft 102 is pressed toward paper feed roller 4 by flange pressing lever 6, so that a force in a direction to paper feed roller 4 is exerted on flange 101, and roll paper 100 comes to be in contact with paper feed roller 4. Further, as there is a projection 52 formed along the L-shaped slit 51 of flange holder 5, shaft 102 abuts projection 52 when pressed by flange pressing lever 6, and therefore, the shaft can be held at a prescribed position and not raised from the holding position.

Other photo printers have been proposed that include such a roll paper feeding device holding the roll paper at a prescribed position (for example, in Japanese Patent Laying-Open Nos. 11-43245 and 58-139950).

In the conventional photo printer such as shown in FIG. 4, however, when roll paper 100 is to be loaded to roll paper feeding device 1, that is, when flange 101 supporting roll paper 100 on its shaft is to be set on flange holder 5, it is difficult to insert shaft 102 to the L-shaped slit 51, as the opening for inserting shaft 102 of flange 101 to the L-shaped slit 51 is narrow. Further, as flange pressing lever 6 is always urged by a spring to the side of paper feed roller, the lever is moved to the position of L-shaped slit 51 when flange 101 is not loaded. Therefore, it is necessary for a user to press flange pressing lever 6 away from the position of L-shaped slit 51 (to a position near the inner surface of housing 2) with one hand and to put flange 101 into L-shaped slit 51 with the other hand. Thus, loading of the roll paper has been much troublesome for the user.

SUMMARY OF THE INVENTION

An object of the present invention is to provide a photo printer allowing easy loading of the roll paper.

The present invention provides a roll paper feeding device with a roll paper supporter axially supporting the roll paper, in which the roll paper is held at a prescribed position and brought into contact with a paper feed roller for feeding, including: a holding portion holding from below opposite ends of the roll paper supporter, having an upwardly opened recess of a length at least longer than the range of movement of the roll paper supporter; and a pressing portion pressing the roll paper supporter onto the holding portion.

In this arrangement, the roll paper supporter is placed in the upwardly opened recess having a length at least longer than the range of movement of the roll paper supporter, and the roll paper supporter placed in the recess is pressed by the pressing portion, so that the roll paper is held and brought into contact with the paper feed roller. The roll paper supporter is simply placed in the recess, and therefore, it is horizontally movable within the range of the recess. The pressing portion continuously presses the roll paper supporter, so that the roll paper supporter can be retained movably.

Further, in the present invention, the roll paper supporter is pressed from above and from the side opposite to the paper feed roller, by the pressing portion.

Because of this arrangement, the roll paper supporter is pressed from above by the pressing portion, and therefore, the holding portion receives the pressed roll paper supporter at the bottom of the recess. Therefore, a member such as the projection of the conventional structure that regulates direction of movement of the roll paper supporter becomes unnecessary. Further, as it is pressed from the side opposite to the paper feed roller, the roll paper supporter moves toward the paper feed roller and is continuously kept in contact with the paper feed roller, even when the roll diameter becomes smaller.

In the present invention, the pressing portion is provided on the cover, covering the roll paper from above.

In this arrangement, as the pressing portion is provided on the cover arranged above the roll paper, the mechanism for pressing the roll paper supporter from above is simplified, and therefore, the pressing portion can be formed in a simple structure. Further, when the roll paper is loaded to the roll paper feeding device, the pressing portion moves away from the holding portion together with the cover, enabling easy loading.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A photo printer including the roll paper feeding device in accordance with an embodiment will be described with reference to the figures.

Figure 1:
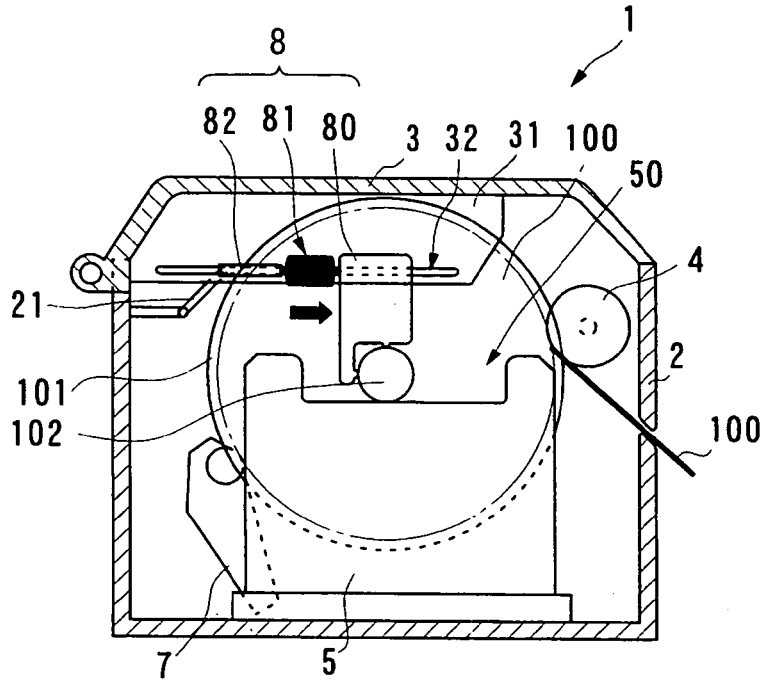
FIG. 1 is a schematic diagram showing the structure of the roll paper feeding device (with the cover closed) of a photo printer in accordance with the present invention.
Figure 2:
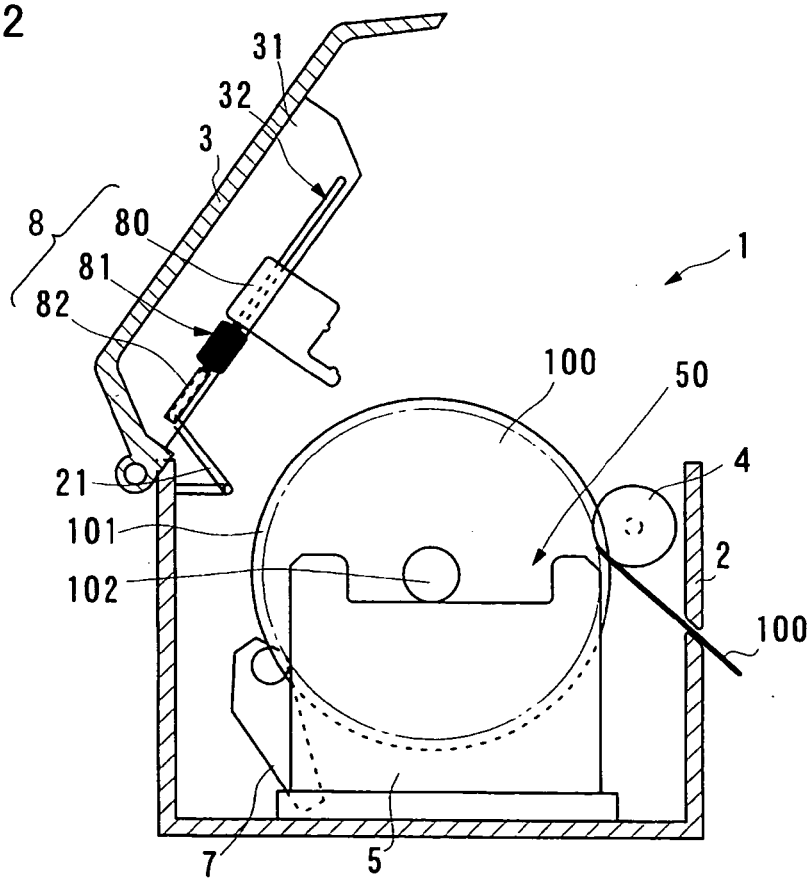
FIG. 2 is a schematic diagram showing the structure of the roll paper feeding device (with the cover opened) of a photo printer in accordance with the present invention.

FIGS. 1 and 2 are schematic diagrams showing the structure of the roll paper feeding device of a photo printer in accordance with the present embodiment, with the cover closed in FIG. 1 and opened in FIG. 2.

As shown in FIGS. 1 and 2, a roll paper feeding device 1 in accordance with the present embodiment includes a paper feed roller 4, a flange holder 5 corresponding to the holding portion of the invention, a flange pressing portion 8 corresponding to the pressing portion of the invention, a roll paper pressing lever 7, a housing 2 containing these components therein, and a cover 3 arranged at an upper portion of the housing.

Roll paper 100 is axially supported by a flange 101 that corresponds to the roll paper supporter of the present invention. Flange 101 has disk shaped side surfaces to be in contact with opposite ends of the roll paper in the width direction and has a shaft 102 to be inserted through the core of roll paper 100.

Flange holder 5 is arranged at a position receiving shaft 102 protruding from opposite ends of flange 101. Flangeholder 5 has, at an upper end, an upwardly opened recess 50 of a prescribed depth and of a length at least longer than the range of movement of the shaft 102 of flange 101. The shaft 102 of flange 101 is placed in recess 50.

A flange pressing member supporting portion 31 is formed on cover 3, and flange pressing member supporting portion 31 has a through slit 32 of which axis extends in a direction approximately parallel to the bottom surface of recess 50 when cover 3 is closed.

Flange pressing portion 8 includes a flange pressing member 80, a spring 81 exerting an urging force to flange pressing member 80, and a base member 82. When cover 3 is rotated and opened or closed, a rotating member 21 provided on housing 2 rotates correspondingly. Rotating member 21 is connected to base member 82, and as rotating member 21 rotates, base member 82 moves toward the center of rotation of cover 3, along the through slit 32. As base member 82 moves, spring 81 and flange pressing member 80 that are connected thereto also move along the through slit 32. Therefore, when cover 3 is open, flange pressing member 80 is held at a position close to the center of rotation of cover 3. When cover 3 is closed, contrary to the state when cover 3 is open, flange pressing member 80 moves in a direction away from the center of rotation of cover 3. Flange pressing member 80 comes to be in contact with shaft 102 of flange 101 at a prescribed position, as it moves. When in contact with shaft 102, flange pressing member 80 receives pressing force from shaft 102, and presses spring 81. Here, base member 82 is fixed by means of rotating member 21, and therefore, a force in a direction to compress spring 81 is applied, and as a reaction, a force urging flange pressing member 80 to move to the direction of shaft 102 is applied. By this urging force, flange pressing member 80 presses shaft 102 from above and from the side, whereby flange 101 having shaft 102 receives the force and is moved in the direction of the arrow shown in FIG. 1, and roll paper 100 comes into contact with paper feed roller 4.

Next, an operation of loading roll paper 100 and printing, using the photo printer having the above-described structure will be described.

A user sets roll paper 100 on flange 101, and opens cover 3 of roll paper feeding device 1. Then, the user puts flange 101 axially supporting roll paper 100 into roll paper feeding device 1, such that shaft 102 is placed in recess 50 of flange holder 5. As flange holder 5, on which flange 101 is to be placed, has recess 50 with wide opening, it is possible for the user to easily set the flange 101.

In this state, flange pressing portion 8 is away from flange holder 5 as cover 3 has been rotated, as shown in FIG. 2. Therefore, different from the prior art, it becomes unnecessary for the user to set flange 101 while moving flange pressing portion 8 with one hand. Thus, the user can very easily set the flange 101.

Further, when flange 101 is set, roll paper pressing lever 7 comes into contact with roll paper 100, and therefore, even when the user releases his/her hold of roll paper 100, roll paper 100 will not get loose. Roll paper pressing lever 7 has such a structure that continuously applies urging force in the direction of roll paper 100 by means of a spring or the like, and therefore, even when roll paper 100 is used continuously and comes to have smaller diameter, the lever keeps pressing roll paper 100 constantly.

When the user closes cover 3, flange pressing member 80 moves in response, and comes to be in contact with shaft 102 of flange 101 from above and from one side. At this time, as flange pressing member 80 is receiving the urging force from spring 81 as described above, flange pressing member 80 presses shaft 102 of flange 101 from above and from the side. Thus, flange 101 moves toward paper feed roller 4, and roll paper 100 is brought into contact with roller 4. As roll paper 100 is in contact with paper feed roller 4, roll paper 100 can surely be fed when paper feed roller 4 is rotated.

Figure 3:
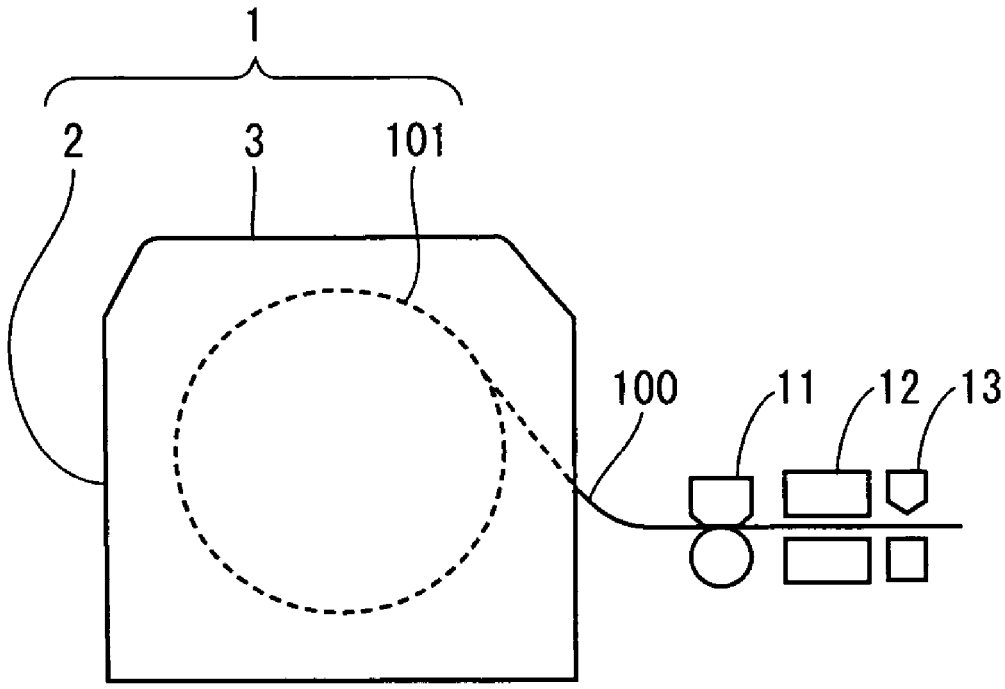
FIG.3 PRIOR ART
FIG. 3 is a schematic diagram of the photo printer.
Figure 4:
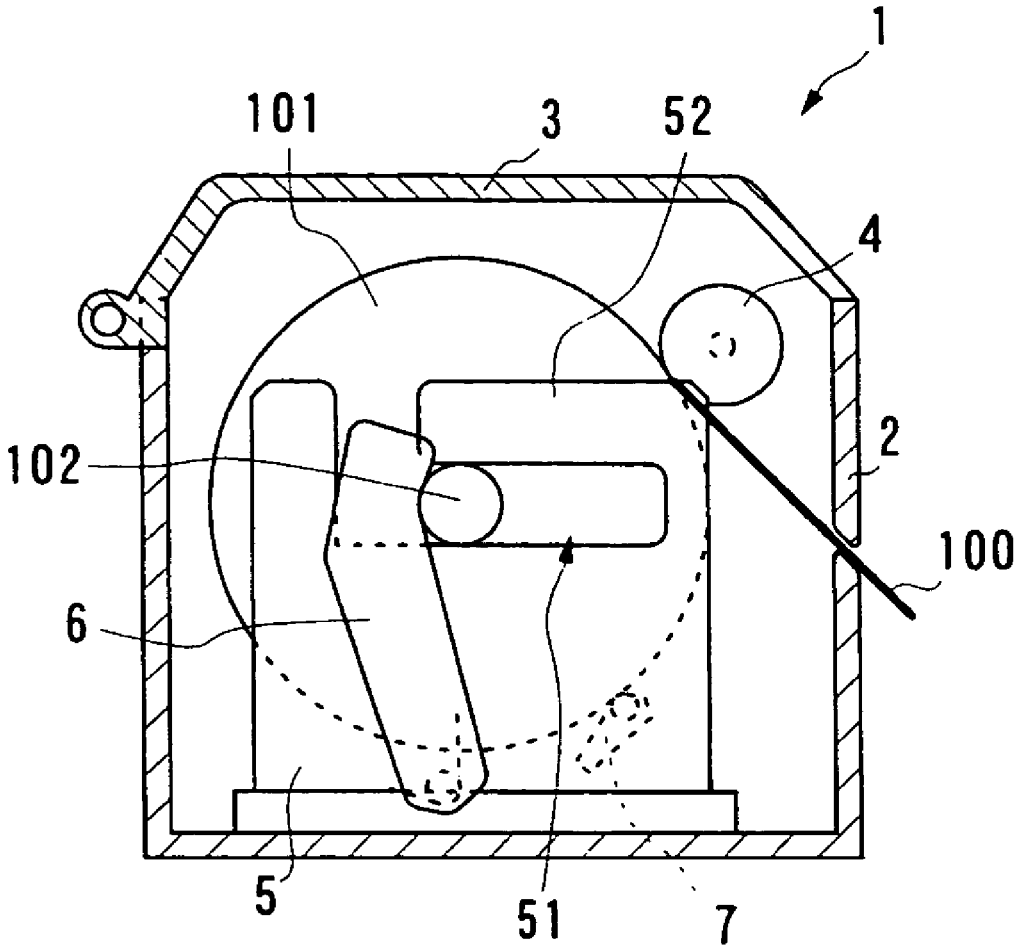
FIG.4 PRIOR ART
FIG. 4 is a schematic diagram showing the structure of a roll paper feeding device of a conventional photo printer.

The fed roll paper is heated in a prescribed pattern at an image forming device so that an image is formed thereon, and then irradiated with ultraviolet ray at an image fixing device so that the image is fixed. The roll paper with the image fixed is cut into a prescribed size, and provided as one photograph (as shown in FIG. 3).

By forming the roll paper feeding device of the photo printer in such a structure, it becomes possible for the user to easily set a flange axially supporting the roll paper in the roll paper feeding device.

In the present invention, the flange holder holding the flange axially supporting the roll paper is provided with a recess with wide opening at an upper end, and the flange is placed in the recess, whereby the flange, and hence the roll paper, can be loaded easily.

Further, in the present invention, the flange pressing portion is provided on the cover, and therefore, when the cover is opened to load the flange, the flange pressing portion moves away from the flange holder as the cover rotates, whereby the flange pressing portion does not interfere with the operation of setting the flange in the flange holder. Therefore, loading of the roll paper is further facilitated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A photo printer, comprising:

a roll paper supporter axially supporting roll paper;

a roll paper feeding device holding the roll paper supporter at a prescribed position and bringing the roll paper into contact with a paper feed roller for feeding;

an image forming device forming an image by heating the roll paper fed from the roll paper feeding device; and an image fixing device fixing said image by irradiating with light the roll paper on which the image has been formed by the image forming device;

wherein said roll paper feeding device includes a holding portion holding from below opposite ends of said roll paper supporter and having an upwardly opening recess of a length at least longer than a range of movement of said roll paper supporter, and a pressing portion provided on a cover of said roll paper feeding device, pressing said roll paper supporter onto said holding portion from above and from a side opposite to said paper feed roller.

2. A roll paper feeding device including a roll paper supporter axially supporting the roll paper, and holding the roll paper supporter at a prescribed position and bringing the roll paper into contact with a paper feed roller for feeding, comprising:

a holding portion holding from below opposite ends of said roll paper supporter and having an upwardly opening recess of a length at least longer than a range of movement of said roll paper supporter; and a pressing portion pressing said roll paper supporter onto said holding portion.

3. The roll paper feeding device according to claim 2, wherein said pressing portion is provided on a cover covering said roll paper from above.

4. A roll paper feeding device including a roll paper supporter axially supporting the roll paper, and holding the roll paper supporter at a prescribed position and bringing the roll paper into contact with a paper feed roller for feeding, comprising:

a holding portion holding from below opposite ends of said roll paper supporter and having an upwardly opening recess of a length at least longer than a range of movement of said roll paper supporter; and a pressing portion pressing said roll paper supporter onto said holding portion, wherein said pressing portion presses said roll paper supporter onto said holding portion from above and from a side opposite to said paper feed roller.

* * * * *